United States Patent [19]

Bakel et al.

[11] 4,045,367

[45] Aug. 30, 1977

[54] GETTER FOR USE IN THE MANUFACTURE OF AN ELECTRIC DISCHARGE TUBE

[75] Inventors: Adrianus Maria Van Bakel; Jan Josephus Bernardus Fransen, both of Eindhoven, Netherlands

[73] Assignee: U.S. Philips Corporation, New York, N.Y.

[21] Appl. No.: 358,636

[22] Filed: May 9, 1973

[30] Foreign Application Priority Data

May 11, 1972 Netherlands ..... 7206375

[51] Int. Cl.[2] ..... H01J 7/18

[52] U.S. Cl. ..... 252/181.4; 252/181.7; 75/170; 75/175.5; 75/134 A; 316/25

[58] Field of Search ..... 252/181.4, 181.7; 75/.5 BB, 67 R, 134 A, 138, 170, 175.5; 316/25

[56] References Cited

U.S. PATENT DOCUMENTS

| | | | |
|---|---|---|---|
| 2,437,097 | 3/1948 | King | 252/181.4 |

FOREIGN PATENT DOCUMENTS

| | | |
|---|---|---|
| 939,042 | 1/1956 | Germany |
| 898,505 | 6/1962 | United Kingdom |
| 1,226,728 | 3/1971 | United Kingdom |

*Primary Examiner*—Jack Cooper
*Attorney, Agent, or Firm*—Frank R. Trifari

[57] ABSTRACT

A getter for use in manufacturing an electric discharge tube contains a mixture of barium aluminum ($BaAl_4$) and a titanium-containing material which contains for at least 50% by weight of FeTi or $NiTi_2$ or of a mixture thereof.

1 Claim, 2 Drawing Figures

GETTER FOR USE IN THE MANUFACTURE OF AN ELECTRIC DISCHARGE TUBE

Figure 1:
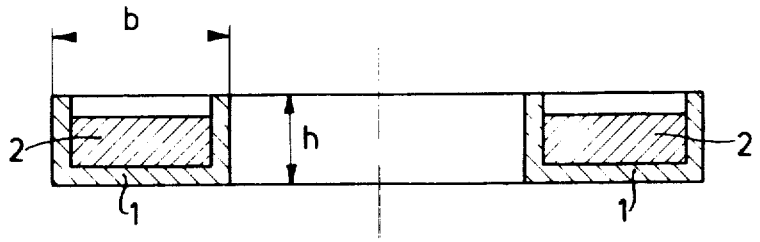

The invention relates to a method of manufacturing an electric discharge tube in which a holder which contains a mixture, termed getter, which mainly consists of barium-aluminium ($BaAl_4$) and a titanium-containing material, is placed in a location inside the glass envelope of the tube, after which at least two glass parts of the envelope of the tube are secured together at high temperature and barium, as the actual getter of the residual gases still present in the tube after evacuation, is then evaporated from the said mixture.

The invention furthermore relates to a getter suitable for such a method, as well as to an electric discharge tube obtained by said method.

In manufacturing an electric discharge tube, for example, a television display tube, it is usual that the getter is placed inside the envelope of the tube after securing the glass conical part of the tube to the glass window. In certain cases, however, it is necessary for the getter to be present already inside the cone before it is secured to the window. Such a case presents itself, for example, when a resistance layer which should restrict the detrimental results of high voltage breakdown, is provided on the inside of the envelope of the display tube at the area where the narrow neck changes into the conical part. It is usual that the getter holder is provided in the conical part of the tube close to the transition from neck to cone by means of a metal strip which is secured at one end to the system of guns. This method cannot be used because the said resistance layer would be short-circuited by the gettering material deposited thereon from the getter. In addition, discharges between the metal strip and the resistance layer are hard to avoid. Another method of placing the getter holder, however, cannot be realized at all or can be realized with difficulty only when the window and the cone are already secured together. For that reason, the holder with the getter provided therein is placed in its position inside the conical part of the tube before the window is secured to the cone. The result of this is that the getter is present during the whole process in which the cone and the window are secured together. This process is carried out in air in a furnace at a temperature of 450° C. A usual composition of the getter, for example, a mixture of barium aluminium powder and nickel powder, can in that case not be used as such since in these circumstances the nickel of the getter is at least partly converted into nickel oxide. It has been found that the resulting variation of the composition produces a getter the constituents of which react so vehemently upon heating that several particles are flung away from it. In addition, too low a barium efficiency which, in particular, is not reproducible, is obtained. Moreover, said separate particles may produce spots on the display screen or result in electric breakdown in the tube.

From the U.S. Pat. No. 2,536,879 it is known to protect a getter from the action of moist air by covering it with a thin layer of aluminium. It has been found, however, that during the manufacture of a tube as described above, a sufficient sealing of the getter is not guaranteed. In addition, such a layer might adversely influence the evaporation rate of the barium from the getter.

Britsh Pat. No. 1,226,728 describes for the manufacture of a colour television display tube a method of the type mentioned in the preamble in which it is stated that a getter consisting of a barium aluminium compound and a nickel titanium compound without a protective layer can be present in the process in which the window and the cone are secured together. However, the nickel-titanium compound is not further described.

Furthermore, a getter consisting of a mixture of a barium aluminium alloy and nickel and/or a nickel titanium compound is known from the British Pat. No. 898505. The nickel titanium compound whose composition is not defined in this case either, would ensure that the getter compressed in a holder maintains its shape during and after the evaporation of the barium.

The usefulness of a getter is determined to a considerable extent by the way in which and the extent to which barium is released from it during the heating. According to a conventional procedure, the getter is inductively heated for approximately 30 seconds. The added quantity of energy per unit time determines how much time passes after the beginning of said heating before the first barium vapour is released from the getter. This time, also referred to as release time, is possibly maintained as short as possible so as to obtain an optimum yield of barium vapour within the overall heating time of approximately 30 seconds. When, however, said release time is chosen to be too short, that is to say when too much energy per unit time is added to the getter, the metal holder in which the getter is provided fuses as a result of which separate parts of getter and holder are obtained in the tube.

It has now been found that, in order to realise a getter which is resistant to the action of oxygen and water vapour at high temperature and which in addition provides a sufficient yield of barium while maintaining its shape and without fusion of the getter holder occurring, not any arbitrary titanium compound can be added to the barium aluminium.

It is an object of the invention to provide a method of the type described in the preamble in which a getter is used which can be exposed, without a protective layer, to the conditions which prevail in securing glass parts of the envelope of the tube and which nevertheless gives a sufficient yield of barium without separate particles of getter and holder being formed in the tube.

According to the invention, in a method of manufacturing an electric discharge tube in which a holder which contains a mixture, termed getter, which mainly consists of barium aluminium ($BaAl_4$) and a titanium-containing material, is placed in a location inside the glass envelope of the tube, after which at least two glass parts of the envelope of the tube are secured together at high temperature and barium, as the actual getter of the residual gases still present in the tube after evacuation, is then evaporated from the said mixture, the titanium-containing material containing for at least 50% by weight of FeTi or $NiTi_2$ or of a mixture thereof.

It is to be noted that a getter which contains barium aluminium and ferrotitanium is known from the German Pat. No. 939042. In this case the ferrotitanium serves as a sintering agent to hold the barium aluminium on its substratum. However, problems as indicated in the above-described method do not present themselves.

A good adherence of the getter to its holder is obtained if of the barium aluminium the aluminium reacts for a part with the metal of the holder. In particular in the case of short release times, however, the possibility exists that the aluminium reacts so vehemently with the material of the holder that said holder fuses locally.

It has been found that particularly useful getters, which can be used for very short release times, are those getters according to the invention whose titanium-containing material consists essentially of 10 to 50% by weight of $Ni_3Ti$. In view of the fact that a getter of which the titanium-containing material consists entirely or substantially entirely of $Ni_3Ti$ gives an insufficient yield of barium and moreover does not maintain its shape during the evaporation of said barium, it is surprising that a getter the titanium-containing material of which contains a restricted quantity of $Ni_3Ti$, has better properties than a getter which does not contain $Ni_3Ti$ at all. Too small a quantity of $Ni_3Ti$ in the titanium-containing material does not provide any improvement of the properties with respect to the fusion of the getter holder in the case of short release times. On the other hand, when a certain quantity of $Ni_3Ti$ in the titanium-containing material is exceeded, the getter shows the undesired properties as mentioned in a getter the titanium-containing material of which contains $Ni_3Ti$ only.

In a getter according to the invention the titanium-containing material preferably consists for 30% by weight of $Ni_3Ti$.

The condition that for a good adherence of the getter to its holder a part of the aluminium of the barium-aluminium compound reacts with the metal of the said holder is necessary but need not be sufficient. The mutual ratio of the dimensions of the channel of the getter holder relative to the content of barium aluminium in the getter is found to be of importance in this respect.

For a getter holder of which the ratio of the dimensions of the depth and the width of the channel lies between 0.4 and 2, according to the invention, a good adherence of the getter to its holder is obtained, if of said getter the weight ratio of the quantity of titanium-containing material and the quantity of barium aluminium is between 0.3 and 1, respectively.

A getter according to the invention can withstand the action of hydrogen and oxygen up to high temperatures and gives a sufficient yield of barium without separate parts of the getter being formed in the tube.

The method according to the invention is preferably used in manufacturing a colour television display tube in which the getter is provided in a place inside the envelope of the tube, for example, on the screening cap, before the conical part is secured to the window at high temperature.

Figure 2:
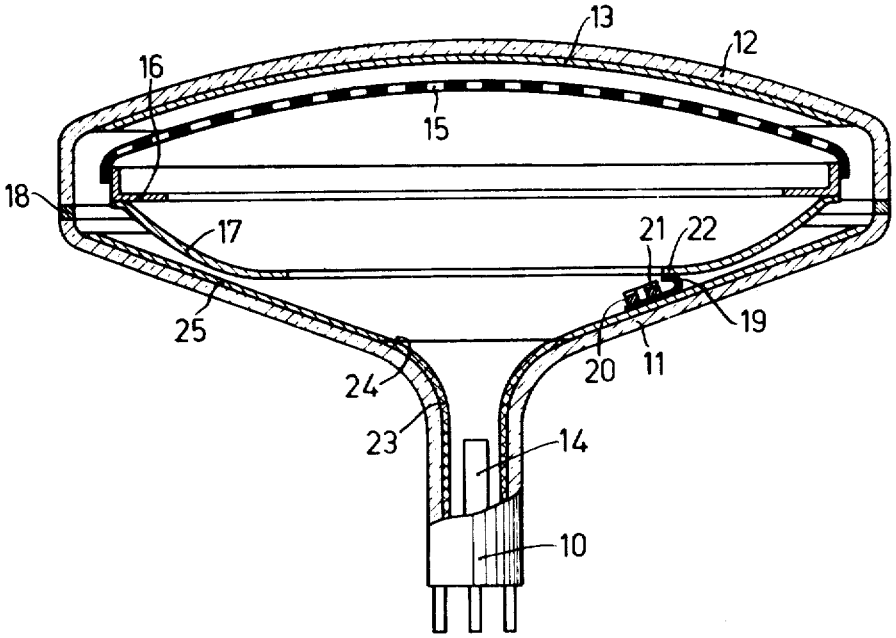

The invention will be described in detail with reference to the accompanying drawing, in which FIG. 1 is an axial sectional view of a getter holder having an annular channel and FIG. 2 is an axial sectional view of a colour television display tube obtained according to the invention.

The holder in FIG. 1 comprises a chromium-nickel-steel channel 1 the depth *h* of which is 2 millimetres and the width *b* is 5 millimetres. The outward diameter of the annular channel 1 is 29.8 millimetres. The getter 2 is compressed in the channel 1 and consists of a mixture of 12 parts by weight of $BaAl_4$, 3 parts by weight of $NiTi_2$ and 1 part by weight of $Ni_3Ti$.

The colour television display tube shown diagrammatically in FIG. 2 comprises a neck 10, a cone 11 and a glass window 12. A phosphor layer 13 consisting of a red, green and blue fluorescent phosphor is provided on the inside of the window. The tube furthermore comprises a shadow mask 15 which is secured to the mask ring 16 as is also a metal screening cap 17. A getter 21 according to the invention is present in a metal annular holder 20 which is secured to one end of a metal strip 19. The other end of the metal strip 19 is welded to the screening cap 17 at 22. At a temperature of 450° C, the window 12 is then secured to the cone 11 at 18. The diagrammatic system of guns 14 is then placed in the neck 10 of the tube after which the tube is evacuated. After evacuation of the tube, the holder 20 and the getter 21 present therein is heated inductively for 30 seconds in such manner that approximately 11 seconds after the beginning thereof the first barium is released from the getter. The place and position of the holder 20 are so that no barium vapour is deposited on the resistance layer 23 which is provided near the transition from neck 10 to cone 11 and which changes at 24 into the usual readily conductive layer 25 provided on the inside of the cone 11. Said vapour is now deposited inside the space formed by the mask 15 and the screening cap 17.

What is claimed is:

1. A getter comprising a mixture essentially of $BaAl_4$ and a titanium-containing material that is 10 to 50% by weight of $Ni_3Ti$ and the balance $Ni\ Ti_2$, and wherein the weight ratio of the respective amounts of said titanium-containing material and said $BaAl_4$ is between 0.3 and 1.

* * * * *